United States Patent [19]

Rodgers et al.

[11] Patent Number: 4,739,155

[45] Date of Patent: Apr. 19, 1988

[54] MINERAL INSULATED PARALLEL-TYPE HEATING CABLES

[75] Inventors: Robert J. Rodgers, Belleville; George J. Tymowski, Ottawa; Udin Kosasih, Kanata, all of Canada

[73] Assignee: Pyrotenax of Canada Ltd., Canada

[21] Appl. No.: 946,761

[22] Filed: Dec. 29, 1986

[30] Foreign Application Priority Data

Jan. 16, 1986 [GB] United Kingdom ..... 8600985

[51] Int. Cl.[4] ..... H05B 3/06; H05B 3/02

[52] U.S. Cl. ..... 219/537; 219/536; 219/539

[58] Field of Search ..... 219/537, 536, 538, 539

[56] References Cited

U.S. PATENT DOCUMENTS

| | | | |
|---|---|---|---|
| 4,626,665 | 12/1986 | Fort, III | 219/537 X |
| 4,645,912 | 2/1987 | Ando et al. | 219/537 X |

FOREIGN PATENT DOCUMENTS

| | | | |
|---|---|---|---|
| 909407 | 5/1946 | France | 219/537 |
| 73117 | 2/1948 | Norway | 219/537 |
| 339464 | 12/1930 | United Kingdom | 219/537 |
| 832503 | 4/1960 | United Kingdom . | |
| 1507675 | 4/1978 | United Kingdom . | |
| 1521460 | 8/1978 | United Kingdom . | |

*Primary Examiner*—Clifford C. Shaw
*Assistant Examiner*—M. M. Lateef
*Attorney, Agent, or Firm*—Parkhurst & Oliff

[57] ABSTRACT

A mineral-insulated parallel type heating cable has at least two copper or other high conductivity busbars and a plurality of separate heating elements each confined to a zone of the cable that is short compared with its total length (e.g. around 2½ to 5 ft). Each of the heating elements is made up of a plurality of sections of metallic high resistance material which extend longitudinally (physically parallel) and connected electrically in series, while the element as a whole is connected across the two busbars. The preform for making the cable is preferably assembled by a technique using insulating material in preformed blocks.

5 Claims, 3 Drawing Sheets

MINERAL INSULATED PARALLEL-TYPE HEATING CABLES

This invention relates to electric cables and more particularly to mineral-insulated heating cables.

Conventional heating cables generate heat by the flow of electric current through a (or more than one) resistance wire extending the whole length of the cable. Since the available electrical supply voltage is generally fixed, any desired heat output per unit length (thermal loading) can be achieved using a given stock cable only by taking one particular length of cable, which may not be convenient to other requirements of the installation.

In polymeric-insulated heating cables, this problem has been overcome, to a large extent, by the provision of "parallel type" cables in which the longitudinally extending wires are of low resistance and act solely as busbars and heat is generated by current flowing from one of these busbars to another (i) through a multiplicity of short heating elements formed by a fine resistance wire extending in a non-linear path and contacting the two busbars at appropriate intervals, or (ii) through a single heating element continuously contacting both of the busbars and composed of a carbon-loaded polymeric material of high electrical resistivity and positive temperature coefficient of resistivity (PTC compositions).

A positive temperature coefficient of resistance is essential to any heating element (throughout the range from minimum ambient to maximum on-load service temperature) since if the coefficient were negative, current would be carried selectively by any part of the element that had, for any reason, a higher than average temperature leading to even higher temperature, further current increase and inevitable thermal runaway failure. Metallic resistance elements generally have a positive temperature coefficient but have relatively low resistivities so that a wire resistance element for generating convenient amounts of heat at the usual supply voltages are either very long or of very small cross-section (and so very fragile) and so the use of metallic conductors in a mineral-insulated parallel-type heating cable has hitherto been rejected.

The need for a mineral insulated parallel-type heating cable was recognised and attempts made to provide it many years ago (see for example British Patent No. 832503) using an inorganic analogue of the polymeric PTC compositions, but it is difficult to make inorganic high-resistivity compositions which have the dimensional and structural stability required to withstand the drawing operation that is essential for mineral-insulated cable manufacture and retains a positive temperature coefficient of resistance thereafter, and it is only recently (British Patent No. 1507675) that we have been able to produce an adequately serviceable cable of this type.

The present invention provides a mineral-insulated parallel-type heating cable with metallic conductors, and includes a preform for drawing down to make such a cable.

The cable in accordance with the invention comprises:

at least two busbars of high conductivity extending continuously from end to end of the cable;

a plurality of metallic heating elements each confined to a respective zone of the cable that is short compared with its total length, each such element being connected at its ends to two different busbars;

a surrounding metallic sheath and compacted mineral insulating material filling up the sheath;

and each of the said elements comprises a plurality of element sections each extending longitudinally and connected electrically in series.

By forming the elements of sections which are electrically in series but physically parallel (or nearly so) it becomes possible to use elements which are robust enough to withstand the drawing operation and yet confined to a sufficiently short length of cable (e.g. 0.5 to 1.5 meters, or even less) to ensure that the cable can be cut at any point without creating an unduly long non-heating section at the end of the cable: the creation of a "cold tail" of the order of 250–750 mm long is a positive advantage, as it reduces the working temperature of the cable termination.

In the simplest forms of the invention, the zones occupied by adjacent heating elements will be wholly distinct and spaced apart from one another, but if the resulting short cool spots are considered undesirable the zones could be arranged in an overlapping relationship by using at least one section in each element that differs in length from the others.

The busbars may be of any metal or combination of metals that has a sufficiently high conductance. Usually copper will be used, but if the resistance element is to be connected directly to them, it may be desirable to provide a covering or insert of a metal that offers a lower contact resistance, e.g. nickel if the resistance element is made from one of the usual nickel alloys.

The busbars may be round, or they may be of any other convenient cross-section; in particular they may be grooved to facilitate connections as further discussed below.

Each heating element may be made from a single length of resistance wire bent either prior to or during assembly to form the required connections between the sections and from each end of the element to the respective busbar. Alternatively, each section may be formed by a separate wire with separating connecting links of higher conductivity; the extra cost of making interconnections (e.g. by welding, brazing or crimping or by inserting the ends in a ferrule that will collapse in the drawing operation) is compensated by simplicity of assembly and the avoidance (or at least reduction) of the risk that distortion of the connections in the drawing process may result in local hot spots. In some cases conductive inorganic non-metallic materials may be applied round the connections to modify contact properties.

Connections to the busbars can be made, in suitable cases, by laying the tail of the element, or of a connecting member associated with it, in contact with the busbar. It may run longitudinally (in either direction) in which case it may be desirable to insert it into a groove in the busbar precursor to reduce risk of insulating material flowing between the members and breaking the contact. In this case (a) nickel or other cladding to facilitate contact may be confined to the groove region and/or (b) the groove may be locally deformed after insertion of the element tail or connecting member to secure it in position prior to the drawing operation.

Whether grooving is used or not, a separate clip of suitable ductile material (e.g. a C-section tube of hard-drawn copper) could be used as an alternative securing means.

Alternatively the element end or connecting member may be wound in a few turns around the busbar or may be welded or brazed to it.

The insulating material may be magnesium oxide or other conventional material, and is preferably used in pre-formed blocks apertured and/or grooved to aid correct spacing of the metal members. However, if the precursors of the heating elements are sufficiently rigid, powder filling into a seam-welded sheath may be a workable alternative; powder filling into a preformed, seamless sheath would be very difficult and is not recommended. Another option, if the heating elements are sufficiently rigid, is to preform a plurality of blocks each embedding the greater part of one heating element, leaving at least the two ends of the element accessible for connections, and threading those blocks onto the busbar precursors; plain insulating blocks will need to be interposed to provide element-to-element insulation if the connections are formed at the opposite ends of the blocks, but are unnecessary when they are both formed at the back end in the sense of the threading operation, since the front end of each block may then be wholly insulating.

The invention will be further described by way of example with reference to the accompanying drawings in which.

Figure 1:
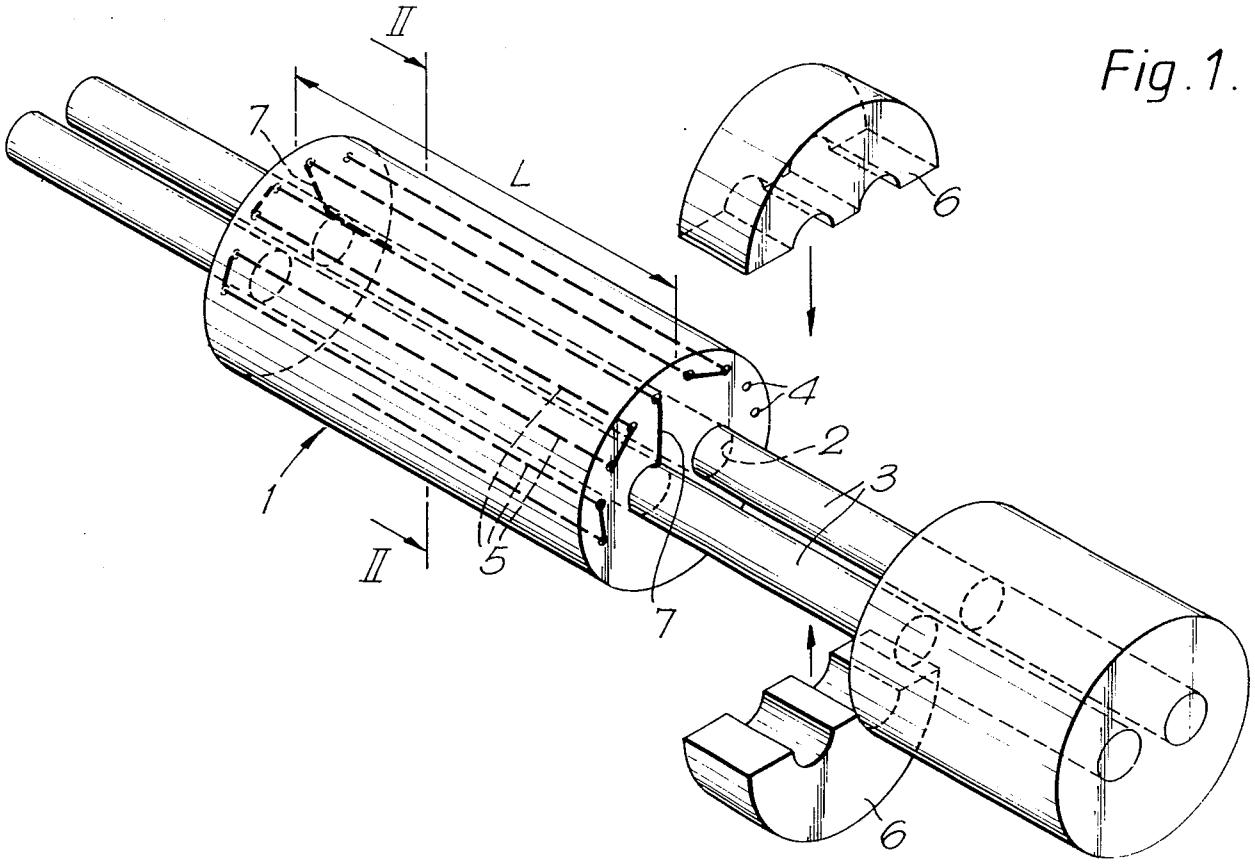
FIG. 1 is a diagrammatic perspective view illustrating the structure and the preferred method of assembly of one particular form of preform in accordance with the invention.
Figure 2:
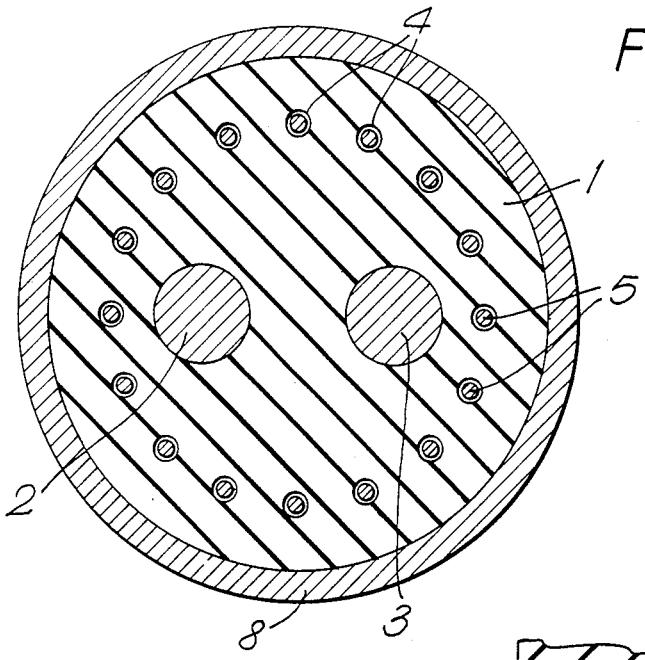
FIG. 2 is a cross section of the line II, II in FIG. 1.
Figure 3:
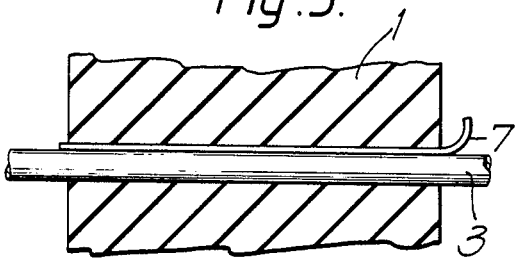
FIG. 3 is a fragmentary view (enlarged but not to scale) showing the method of making a connection to a busbar in the example of FIGS. 1 and 2.

The preform shown in FIGS. 1–3 comprises two different types of preformed insulating block. The major blocks 1 are generally cylindrical in shape with (in this particular case) eighteen longitudinally extending bores, two of which are located in positions relatively close to the centre of the block and receive the rods 3 of nickel-clad copper which are the precursors of the busbars of the finished cable, and the other sixteen bores 4 are uniformly spaced near the periphery of the block and receive the corresponding number of resistance wire precursor sections 5. These blocks alternate with pairs of spacer half-blocks 6 which provide insulation between adjoining heater element sections. This design of preform requires the resistance wire precursor of the element to be relatively flexible (unless separate connectors are used to make all the section-to-section connections) since the precursor is threaded through the block apertures one by one with the sections interconnected by bends in the precursor, and the element ends 7 are tucked each inside one of the bores 2 where it will be in close contact with the respective busbar, for a substantial length (for the full length of the block if desired), as shown in FIG. 3. The major blocks 1 are threaded over the rods 3 and the spacer block 6 inserted laterally as indicated by the arrows in FIG. 1 and the resulting sub-assembly simultaneously or subsequently inserted into a copper tube of appropriate diameter which is the precursor 8 of the cable sheath. The preform is then reduced in cross-section by a drawing process (optionally preceded by swaging) in accordance with conventional practice in the mineral-insulated cable industry. The finished assembly is annealed, and intermediate annealing between drawing stages may be necessary. A plastics oversheath may be extruded onto the finished cable for the sake of corrosion resistance or appearance if desired.

Figure 4:
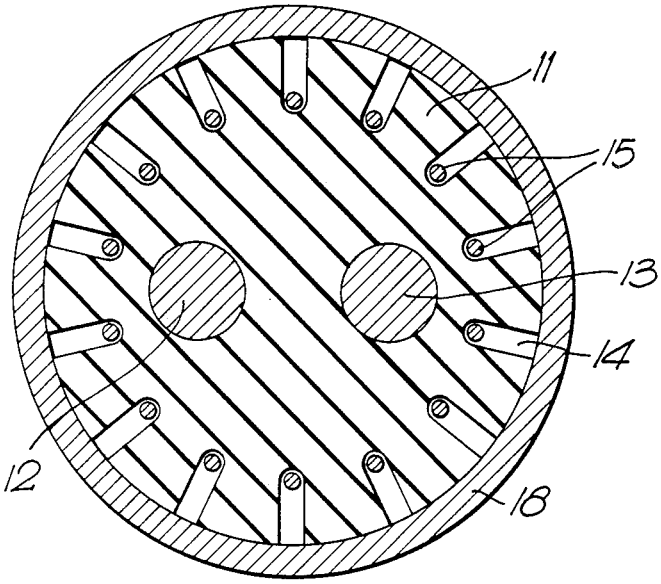
FIG. 4 is a cross-section corresponding to FIG. 2 and illustrating an alternative preform in accordance with the invention.

The alternative arrangement shown in FIG. 4 (in which corresponding parts have a reference numeral ten higher than those in FIGS. 1 to 3) the main insulating block 11 is formed with slots 14 exposed to the peripheral surface instead of the bores 4. This makes the threading up of the resistance wire 15 which is to form the heating element much easier, but may be unreliable because it relies upon the inward progress of the reduction process to ensure that the element sections do not contact the sheath precursor 18. Insulating bars could be inserted in the mouths of the slots 14 after winding the resistance wire to reduce the risk.

Figure 5:
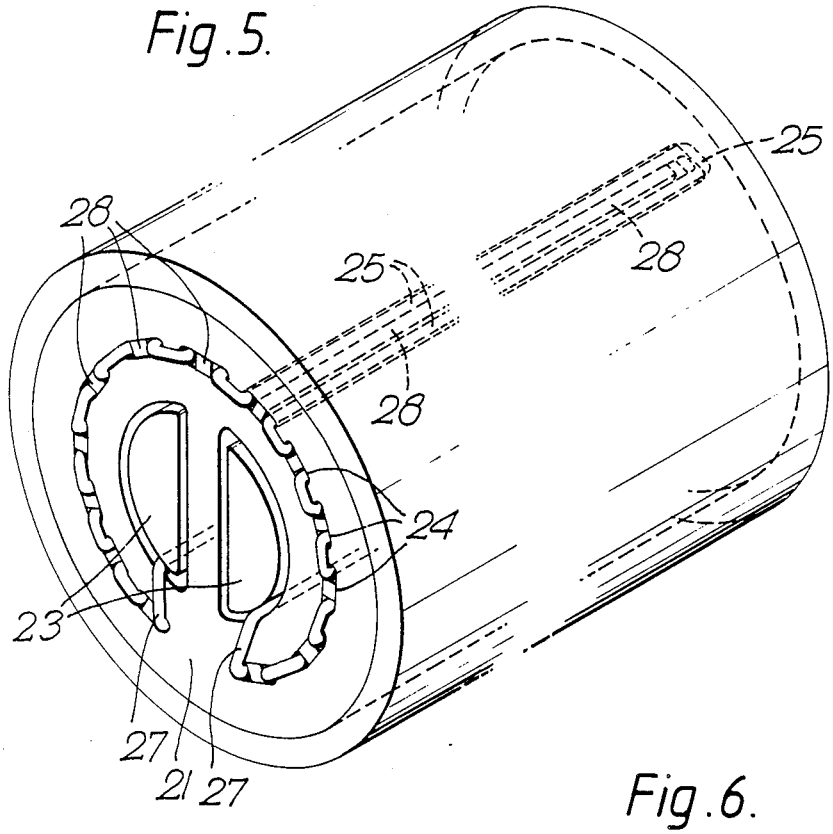
FIG. 5 is an end view (with a partial isometric representation) of a different preform in accordance with the invention, seen partly assembled.

The alternative preform illustrated in FIG. 5 avoids that risk, and also permits the use of an even stiffer heating element precursor. The main insulating block 21 is formed with a plurality of passages 24 of elongate cross-section and appropriate passages for the busbar precusors 23 (for purpose of illustration shown D-shaped, which provides a more compact and more flexible cable and reduces material costs). The heating element precursor wire is preformed to establish parallel limbs 25 interconnected by U-bends and ends 27 for contacting the busbar precursors as in the previous examples. Two adjacent limbs 25 (with the U-bend joining them) are inserted in each of the passages 24 and a bar 28 (pressed from the same material as the main insulating block 21) is then inserted between them to provide insulation between limb and limb. Spacer half-blocks (not shown) suited to the busbar shape complete the preform, which is processed as before.

Figure 6:
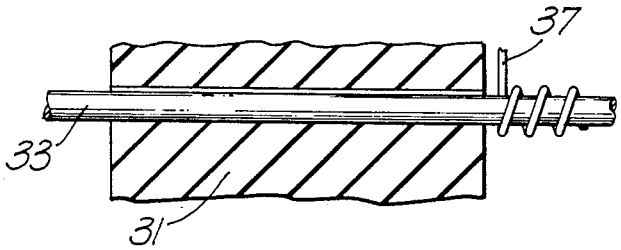
FIG. 6 is a view, corresponding to FIG. 5, showing an alternative method of making a connection to a busbar.

FIG. 6 illustrates an alternative way of connecting the heating element to the busbar by wrapping the tail 37 of the heating element precursor around the exposed part of the busbar precursor 33, where it will in due course be surrounded by the spacer half-blocks 6.

EXAMPLE 1

A preform of the general kind shown in FIGS. 1–3 was made using two round, nickel-clad copper busbar precursors each 2.5 mm (0.100 inch) in diameter and a plain stainless steel (304) sheath precursor with internal and external nominal diameters of 21 and 25 mm (0.83 and 1.00 inch) respectively. The main insulating blocks were pressed from magnesium oxide and were 90 mm (3.5 inches) long and 19.8 mm (0.78 inch) in diameter; the two bores for the conductor precursor were 3.4 mm (0.135 inch) in diameter and there were five (rather than the fourteen shown in the drawing) for the heating element precursor, each 2.9 mm (0.115 inch) in diameter. Each heating element precursor was a round nickel-chromium wire 0.8 mm (0.032 inch) in diameter and about 622 mm (2 ft 0½ inch) long, threaded up to form longitudinally extending limbs connected in series as shown in the drawings (except that, in view of the odd number of limbs, the tails 7 were formed at opposite ends of the block). The spacer blocks were of corresponding cross-section and 6.4 mm (0.250 inch) long.

This preform was drawn to 7 mm (0.28 inch) outer diameter by conventional M.I. cable manufacturing techniques, and annealed. The resulting cable had heating sections about 813 mm (2 ft 8 inch) long with gaps 127 mm (5 inch) between them; its electrical loading was 110 watt per heating section, or nominally 135 watt per meter (3.4 watt per inch) after disregarding any cold section (up to a maximum of 1 meter (3 ft) long at each end. (all wattages in these examples are at 110 V, 60 Hz).

EXAMPLE 2

The preforms of this example was as shown in FIG. 5. The electrode rod precursors were nickel-clad copper and were nominally segments of a cylinder of 16 $mm^2$ (0.025 sq. inch) in cross-section; the sheath precursor was the same as in Example 1. The main insulating blocks were 114.3 mm (0.45 inch) long and 20.3 mm (0.800 inch) in diameter, and were shaped to give a clearance of 0.38 mm (0.015 inch) round the busbar precursors. There were thirteen of the passages 24, each of cross-section about 2.7 by 1.3 mm (0.105 by 0.050 inch), and each of these received a spacer bar 28 measuring 1.0 by 0.8 mm (0.040 by 0.3 inch).

The nickel-chromium element precursors were each 2.64 m (8 ft 8 inch) long. Spacer half-blocks were 12.7 mm (0.5 inch) long.

Other dimensions and properties of the finished cable were as follows:

| | | |
|---|---|---|
| element precursor diameter | (mm) | 0.7 |
| | (inch) | 0.028 |
| finished outer diameter | (mm) | 7.1 |
| | (inch) | 0.280 |
| length of heating section | (m) | 0.914 |
| | (inch) | 36 |
| length of gap between heating | (mm) | 178 |
| sections | (inch) | 7.0 |
| watts per heating section | | 18 |
| nominal watts per meter | | 20 |
| nominal watts per inch | | 0.5 |

EXAMPLE 3

This was identical with Example 1 except that the element ends were terminated in the manner shown in FIG. 5 making 3 tightly wrapped turns. Tests on dissected samples did not show any apprecible differences of contact resistance in comparison with an Example 1 cable.

Each of these examples can be modified, to achieve required power ratings, by altering (i) the size (or the composition) of the resistance wire used to form the resistance wire precursor and/or (ii) the number of legs formed by the reistance wire precursor and/or (iii) the length of those legs and/or (iv) the draw-down ratio.

What we claim as our invention is:

1. A mineral insulated parallel-type heating cable for cutting to length to obtain a heat output per unit length that is, for a given supply voltage, insensitive to the length comprising:

at least two busbars of high conductivity extending continuously from end to end of the cable;

a plurality of metallic heating elements each confined to a respective zone of the cable, said zone being short compared with the total length of the cable, each such element being connected at its ends to repsective places on two different said busbars that are in respective ones of said zones;

a surrounding metallic sheath and compacted powdered mineral insulating material completely filling up said sheath;

wherein each said element comprises a plurality of element sections each extending longitudinally, parallel to the cable axis and alongside one another, and connected electrically in series.

2. A cable as claimed in claim 1 in which said zones occupied by adjacent said heating elements are wholly distinct and spaced apart from one another.

3. A cable as claimed in claim 1 in which said zones occupied by adjacent heating elements are arranged in an overlapping relationship, at least one section in each element differing in length from the others.

4. A heating cable as claimed in claim 1 in which each said heating element is made from a single length of resistance wire bent to form the required connections between the sections and from each end of the element to the respective busbar.

5. A cable as claimed in claim 1 in which each said section of at least one of the said elements is formed by a separate wire with separate connecting links of higher conductivity.

* * * * *